United States Patent [19]

Cristian

[11] Patent Number: 4,640,013

[45] Date of Patent: Feb. 3, 1987

[54] DEVICE FOR WRAPPING A JUNCTION BAND AROUND A PAIR OF CIGARETTES

[75] Inventor: Athos Cristian, Bologna, Italy

[73] Assignee: SASIB S.p.A., Bologna, Italy

[21] Appl. No.: 529,854

[22] Filed: Sep. 6, 1983

[30] Foreign Application Priority Data

Sep. 10, 1982 [IT] Italy ..... 12618 A/82

[51] Int. Cl.[4] ..... A24C 5/47

[52] U.S. Cl. ..... 131/94

[58] Field of Search ..... 131/94, 95

[56] References Cited

FOREIGN PATENT DOCUMENTS 36010 2/1965 German Democratic Rep. ... 131/94

682379 2/1965 Italy ..... 131/94

*Primary Examiner*—V. Millin

*Attorney, Agent, or Firm*—Spencer & Frank

[57] ABSTRACT

A device for wrapping a junction band (T) around the abutting ends of two aligned cigarettes (S) and one double filter (F) interposed therebetween includes a rotary supporting drum (1) having a peripheral assembly of equally spaced wrapping units. Each wrapping unit includes a wrapping member (12) affixed to in the drum and having an active concave surface (212), and an associated wrapping member (11) which is angularly movable with respect to the fixed wrapping member and which has an active convex surface (111). The movable wrapping member is moved cyclically with respect to the fixed wrapping member, starting from an initial angular position (B) where the active surface of the movable wrapping member is exposed and a receiving end portion thereof receives a cigarettes-and-filter assembly, with a junction band being attached thereto by an end margin thereof. The receiving end then moves towards the fixed wrapping member, whereupon, the cigarettes-and-filter assembly meets the fixed wrapping member and is rolled thereby over the active surface of the movable wrapping member to wrap the junction band. The wrapping operation terminates at an angular position (C) where the active surface of the movable wrapping member and a delivery end portion thereof are directed toward the active surface of the fixed wrapping member. The movable wrapping member then rotates back to the initial position, and during this return movement is picked up from the delivery end of the movable wrapping member.

14 Claims, 5 Drawing Figures

T
B
SFS
A1
3
T
SFS
34
SFS
11
12
35
12
11
116
1
16
SFS
C
9
4
A

DEVICE FOR WRAPPING A JUNCTION BAND AROUND A PAIR OF CIGARETTES

BACKGROUND AND SUMMARY OF THE INVENTION

This invention relates to a device for wrapping a junction band or covering sticker around the abutting ends of two aligned cigarettes and one double filter interposed therebetween, in the manufacture of filter-tipped cigarettes.

The device according to the invention is of the type wherein a rotary supporting drum mounts a peripheral annular assembly of wrapping units angularly equispaced from each other and each comprising two cooperating wrapping members formed with opposite arcuate active surfaces, one convex surface and one concave surface, respectively, which are co-axial with and spaced from each other, and wherein each of said wrapping units is cyclically fed with an assembly formed by two aligned cigarettes and one double filter interposed therebetween and with one junction band attached thereto and to be wrapped around said filter and adjacent ends of the two cigarettes by rolling the cigarettes-and-filter assembly by means of suitable relative angular movement of both wrapping members, around the common axis of their opposite arcuate active surfaces.

A device of this type is known from the U.S. Pat. No. 3,307,561. In this known device, both cooperating wrapping members of each wrapping unit are movable, while the assembly of two cigarettes and one double interposed filter is disposed and held in a respective suitable seat on the rotary supporting drum and—upon the rolling step for wrapping it in the junction band—it is rotated around its longitudinal axis without leaving its seat or changing its relative position on the supporting drum. This known device, therefore, requires two control means for actuating the two wrapping members. Moreover, the junction band attached to the assembly of two aligned cigarettes and one interposed double filter must be initially bridged on said cigarettes-and-filter assembly and then must be bent into a U-shape around said cigarettes-and-filter assembly. This known device is of very complicated construction and is not suitable for very high rates of speed.

This invention aims to eliminate these and other drawbacks of the known devices described above, and is substantially characterized in that one of the wrapping members, preferably the one having a concave active surface, is fixedly monted in the supporting drum, while the other wrapping member, preferably the one having a convex active surface, is provided with an end portion for receiving the cigarettes-and-filter assembly with a junction band attached thereto by an end thereof, and with an end portion for delivering the cigarettes-and-filter assembly wrapped in the junction band, and is movable cyclically with respect to the fixed members, each cycle beginning from an angular position of wrapping initiation, wherein its active surface is exposed, and its receiving end moves forwardly towards the fixed wrapping member and in front thereof until it reaches an angular position wherein the wrapping operation is terminated, wherein its active surface and its delivery end portion are directed toward the active surface of the fixed wrapping member. The movable wrapping member is then moved back from the angular position of wrapping termination to the angular position of wrapping initiation. The arrangement is such that in the angular position of wrapping initiation, the movable wrapping member cooperates with feeding means and receives, at its receiving end, the cigarettes-and-filter assembly, with the junction band stretched on the active surface of said movable wrapping member, toward the delivery end thereof. Thereafter, during the angular advancing movement of the movable wrapping member, the cigarettes-and-filter assembly meets the fixed wrapping member and is rotated thereby over the active surface of the movable wrapping member from the receiving end to the delivery end thereof, whereby it is wrapped in the junction band. During the return angular movement of the movable wrapping member, its delivery end cooperates with means to pick up the cigarettes-and-filter assembly wrapped in the junction band.

The advancing angular movement of the movable wrapping member from its wrapping initiation position to its wrapping termination position, and the successive angular return movement of said movable wrapping member from its wrapping termination position to is wrapping initiation position can occur either in opposed directions or in the same direction, i.e., the movable wrapping member can effect either a rotary reciprocating movement or a rotary unidirectional movement.

With respect to the known status of the art constituted by the U.S. Pat. No. 3,307,561, the device according to the invention has the advantage of a simpler construction, in that it requires the actuation of only one of the wrapping members of each wrapping unit on the rotary supporting drum. Moreover, the junction band is not to be straddled on the cigarettes-and-filter assembly with interposed double filter, but it is attached to said assembly by one of its ends and is then stretched over the active surface of the movable wrapping member. Since this junction band is wrapped around the cigarettes-and-filter assembly by a simple rotation of said cigarettes-and-filter assembly in a single direction over the surface of the movable wrapping member by the action of the active surface of the corresponding fixed wrapping member, it will be thus possible to attain very high operating speed rates together with a great precision of rotation.

BRIEF DESCRIPTION OF THE DRAWINGS

The particular features of the device according to the invention and the advantages resulting therefrom, will be apparent with greater details from the following description of an embodiment thereof, illustrated as a non-limiting example in the accompanying drawings, wherein.

DESCRIPTION OF THE PREFERRED EMBODIMENT

With reference to the drawings, the illustrated device is used on the automatic machines for manufacturing filter-tipped cigarettes, wherein two aligned cigarettes S and an interposed double filter F are connected together by means of a junction band or covering stricker T which is wrapped around the filter F and the ends of two cigarettes S adjacent thereto. The double-length cigarette thus obtained is then divided into two single-length filter-tipped cigarettes by a transverse cut at the center of the interposed double filter.

Figure 1:
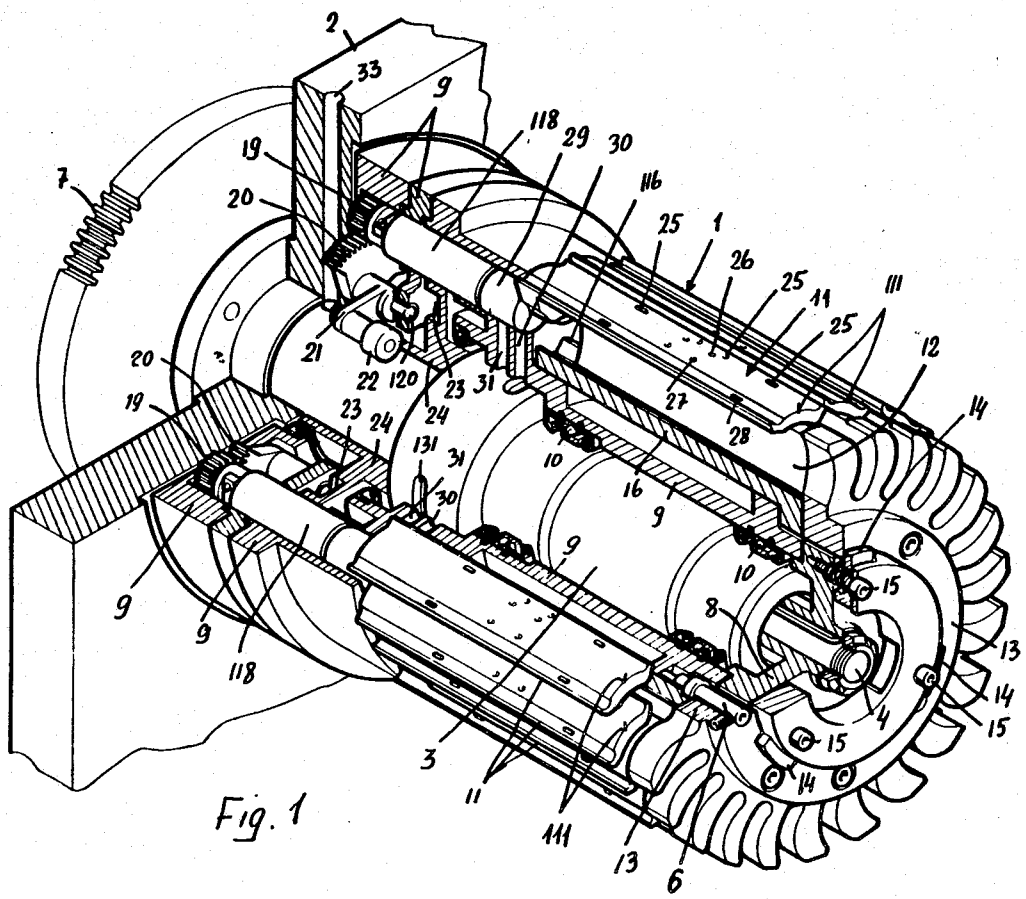
FIG. 1 is a perspective view of a device according to the invention, some portions being broken away to show the internal members in sectional view.
Figure 2:
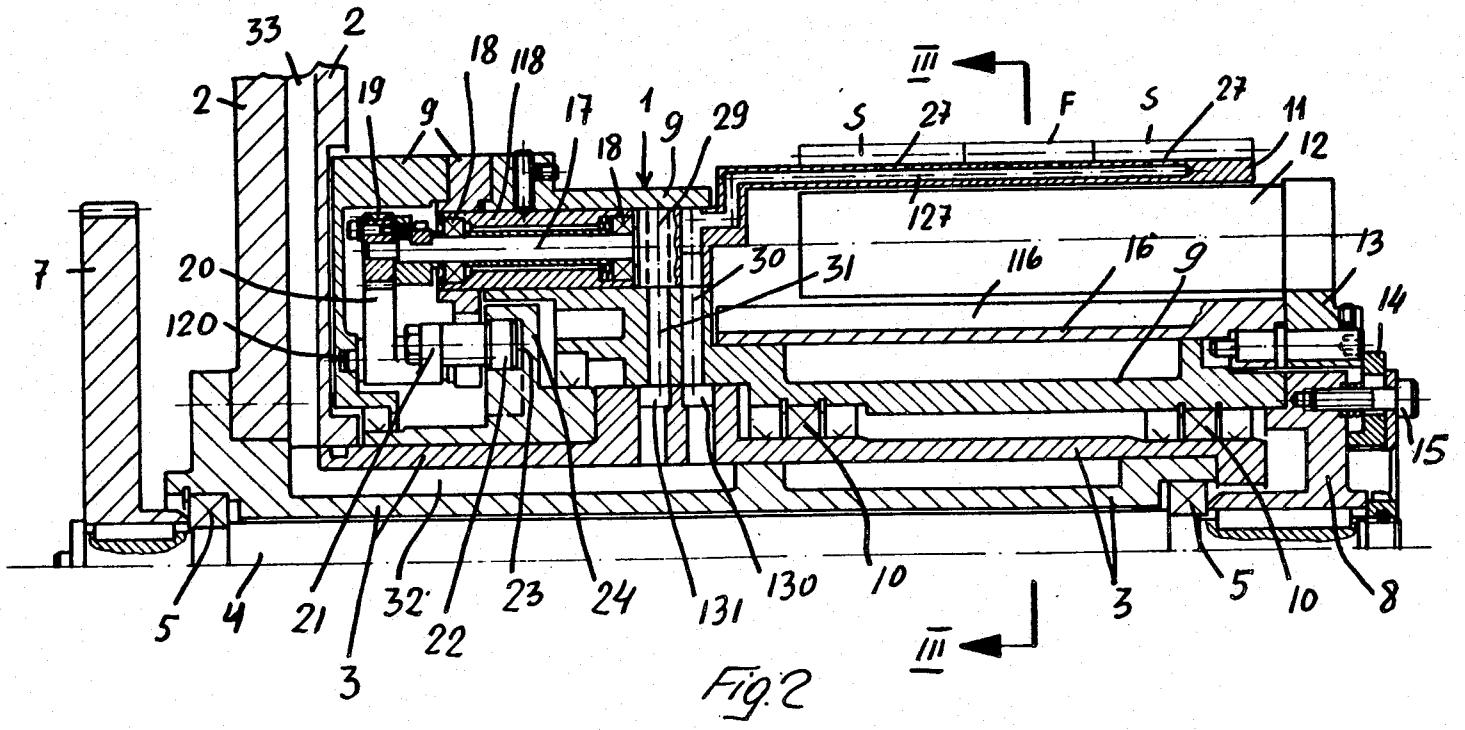
FIG. 2 is a longitudinal sectional view of the upper portion of the device of FIG. 1.

The illustrated device is designed to wrap a suitably glued juntion band T around the inner ends of the two aligned cigarettes S and interposed double filter F (FIG. 2).

The device according to the invention comprises a supporting drum 1 actuated so as to rotate around its longitudinal axis. In the illustrated embodiment, the frame 2 of the device has affixed thereto, in cantilever fashion, a stationary tubular member 3 having a shaft 4 rotatably mounted therein through bearings 5. The rear end of the shaft 4 projects out of the stationary tubular member 3 and mounts any suitable rotational actuating means, for example a gear wheel 7. The opposite front end of the shaft 4 is also projecting out of the tubular member 3, and connected thereto through a flange 8 is the rotatable, substantially tubular structure 9 of the drum 1. This tubular structure 9 of the drum 1 is rotatably mounted on the stationary tube 3 and is supported thereby through bearings 10.

The drum 1 carries a peripheral assembly of wrapping units angularly equi-spaced from each other and each comprising a movable wrapping member 11 and an associated fixed wrapping member 12. The fixed wrapping members 12 rotate together with the supporting drum 1 and are fixed thereon, while the movable wrapping members 11, besides rotating together with the drum 1, are movable with respect to the fixed wrapping members 12 associated therewith.

The fixed wrapping members are formed by an annular assembly of substantially radial wings extending axially of the frum 1, which are parallelly spaced from each other. The fixed wrapping members 12 are secured, at the ends thereof directed toward the free front end of the tube 3, to a ring member 13 fixedly locked on the flange 8 and, threfore, to the rotating structure 9 of the drum 1 through spring brackets 14 and corresponding axial screws 15. The ring member 13, carrying the overhanging annular assembly of fixed wrapping members 12, is also integral with a sleeve 16 which is co-axial with the tube 3 and is mounted on the supporting structure 9 for the drum 1 inside the annular assembly of the fixed wrapping members 12. The sleeve 16 is formed with outer longitudinal ribs 116 of triangular cross-section. A longitudinal rib 116 on the sleeve 16 is asssociated with each fixed wrapping member 12. Specifically, the fixed wrapping members 12 have each a crescent cross-section, the convex side 112 of the crescent facing forwardly with respect to the direction of rotation A of the drum 1. The inner pointed end of the crescent cross-section of each fixed wrapping member 12 is directed toward the apex of the triangular cross-section of the associated rib 116. The concave side 212 of the crescent cross-section of each fixed wrapping member 12 is facing backwards with respect to the direction of rotation A of the drum 1, and its imaginary extension substantially coincides with the planar rear side (with respect to the direction of rotation A) of the triangular cross-section of the associated respective rib 116, as seen particularly in FIG. 3. Thus, arcuate and substantially radial channels are formed between the fixed wrapping members 12, each channel opening inwards between two longitudinal ribs 116 and being closed substantially by said ribs 116, while being open peripherally on the drum 1. A movable wrapping member 11 can be accommodated in each of said channels.

The movable wrapping members 11 are in the form of bent tiles and are each secured in cantilever fashion to a respective spindle 17 rotatably mounted through bearings 18 and a sleeve 118 in the rotatable structure 9 of the drum 1 and parallel to the longitudinal axis of said drum 1. Each spindle 17 may be rotated in either direction by any suitable means. In the illustrated embodiment, secured to the end of each spindle 17 opposite to the movable wrapping member 11 is a pinion 19 meshing with a toothed sector 20 rotatably mounted on pivots 120 in the rotating structure 9 of the drum 1. The toothed section 20 is integral with a lever arm 21 provided with an end roller 22 engaged in a cam groove 23 formed in a ring member 24 which is secured to the tubular member 3 and, therefore, is stationary and does not rotate with the drum 1. By suitably shaping the cam groove 23, the lever 21 and respective toothed sector 20 may be imparted any combination of angular movements during a round-angle rotation of the rotating drum 1, correspondingly displacing the pinion 91, spindle 17 and respective movable wrapping member 11.

Figure 5:
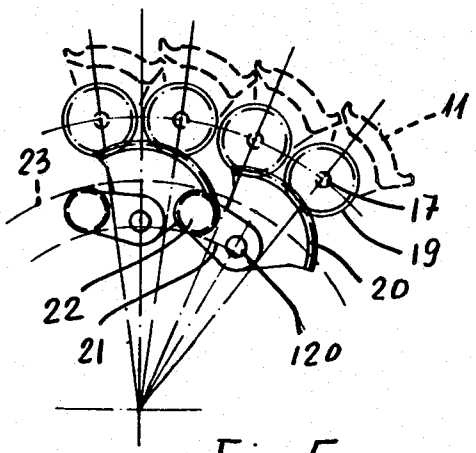
FIG. 5 is an axial fragmentary view of the actuating means of the movable wrapping members.

Each movable wrapping member 11 may be associated with a respective driving toothed section 20. To simplify the construction and reduce the overall dimensions, the pinions 19 of the two or more movable wrapping members 11 may mesh with the same driving toothed sector 20, as shown in FIG. 5.

Each movable wrapping member 11 rotates about an axis located substantially within the outline of the fixed wrapping member 12 upstream of the arcuate channel associated with the movable wrapping member 11 (with respect to the direction of rotation A of the drum 1). Each movable wrapping member 11 may assume the two following angular end positions: a wrapping initiation position, shown in the top portion B of FIG. 3, and a wrapping termination position, shown in the bottom portion C of FIG. 3. In the wrapping initiation position, the movable wrapping member 11 is positioned radially outwards of the upstream fixed wrapping member 12, and its convex entirely-exposed surface 111 is facing outwards and is substantially co-axial with the drum 1. In the wrapping termination position, however, the movable wrapping member 11 is positioned entirely in the respective arcuate radial channel formed between the upstream fixed wrapping member 12 and the downstream fixed wrapping member 12 (with respect to the direction of rotation A of the drum 1).

The convex surface 111 of each movable wrapping member 11 constitutes the active surface of said member with regard to the wrapping of the junction band T around the cigarettes-and-filter assembly SFS, and it cooperates for this purpose with the concave active surface 212 of the fixed wrapping member 12 located downstream (with respect to the direction of rotation A of the drum 1). Both the convex active surface 111 of each movable wrapping member 11 and the corresponding concave active surface 212 of the associated downstream fixed wrapping member 12 are of cylindrical shape and co-axial with the axis of rotation of the respective movable wrapping member 11. The difference between the radius of the convex active surface 111 of the movable wrapping member 11 and the radius of the corresponding concave active surface 212 of the associated fixed wrapping member 12 is slightly smaller than the diameter of a cigarette S. This difference may be varied by slackening the locking action of the brackets 14 and by rotating the excentric member 6.

The convex active surface 111 of each movable wrapping member 11 comprises—at its receiving end which is directed forwardly during the angular movement of the movable wrapping member from its wrapping initiation position to its wrapping termination position—a ridge or shoulder 211 which merges with said convex surface 111 through an arcuate concave surface designed to assemble the cigarettes-and-filter assembly SFS and having substantially the same diameter as said cigarettes-and-filter assembly. At its opposite or delivery end which is directed rearwardly during the angular movement of the movable wrapping member from its wrapping initiation position to its wrapping termination position, the convex active surface 111 of each movable wrapping member 11 comprises a recess 311 designed to receive the cigarettes-and-filter assembly SFS. The ridge 211, rather than merging through a concave surface with the convex surface 111, may merge through a concave surface with a recess or shallow depression formed in the convex active surface 111 of said movable wrapping member 11.

Suction holes 25, 26, 27, 28 are provided in the convex active surface 111 of each movable wrapping member 11. The suction holes 25 are located at the concave merging surface between the shoulder 211 and the convex cylindrical surface 111. The suction holes 26 are located in proximity to said merging surface. The suction holes 25 ans 26 are designed to pneumatically hold the cigarettes-and-filter assembly and the junction band attached thereto when they are laid down onto the convex active surface 111 of the movable wrapping member 11. The suction holes 27 are located in the intermediate portion of the convex active surface 111 of the movable wrapping member 11 and are designed to pneumatically hold the junction band T before and while being wrapped around the cigarettes-and-filter assembly SFS. The suction holes 28 are located in the recess 311 at the delivery end of the movable wrapping member 11 and are designed to hold the cigarettes-and-filter assembly SFS on completion of the wrapping operation in the junction band T.

The suction holes 25, 26, 27, 28 of each movable wrapping member 11 are connected to the suction source through respective longitudinal manifold ducts 125, 127, 128 formed in the bent tile-shaped body of the movable wrapping member 11, and through a rotary cylindrical distributor 29 keyed to the spindle 17 and rotating therewith. The longitudinal ducts 125 and 127, corresponding to the suction holes 25, 26 and 27, are connected to the same peripheral opening 129 of the rotary cylindrical distributor 29 associated with a radial duct 30 formed in the rotating structure 9 of the drum 1. The longitudinal duct 128 corresponding to the suction holes 28 is connected to another peripheral opening of the rotary cylindrical distributor 29, associated with another radial duct 31 formed in the rotating structure 9 of the drum 1. Each annular assembly of radial ducts 30, 31 opens at an associated circumferential slot 130, 131 formed peripherally in the stationary tube 3 and extending through a pre-established angle. These slots 130, 131 communicate with a chamber 32 formed in the tube 3 and connected to a suction duct 33 formed in the frame 2 of the device. The suction effect through the suction holes 25, 26, 27, 28 can thus be controlled both with regard to the angular position of each movable wrapping member 11 (through the respective cylindrical distributor 29 and associated ducts 30, 31) and with regard to the angular position of the drum 1 (through the slots 130, 131 cooperating with the conduits 30, 31).

Figure 3:
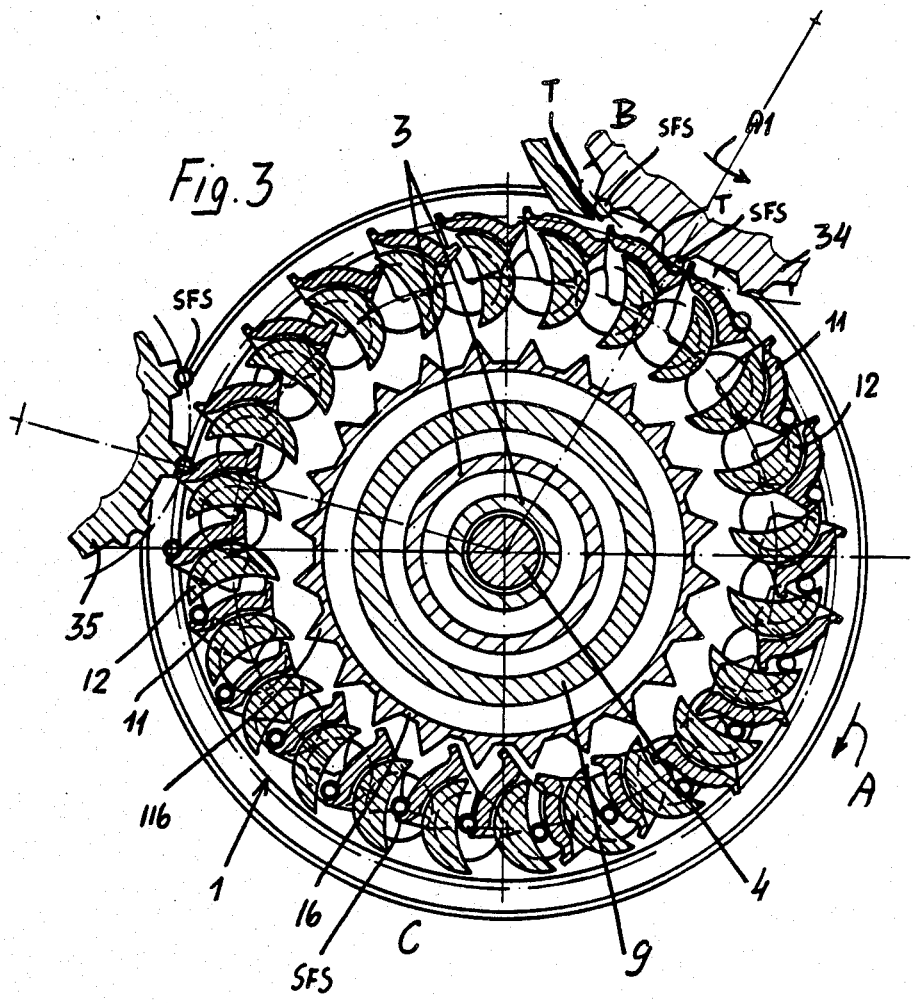
FIG. 3 is a cross-sectional view of the device, on the line III—III of FIG. 2.
Figure 4:
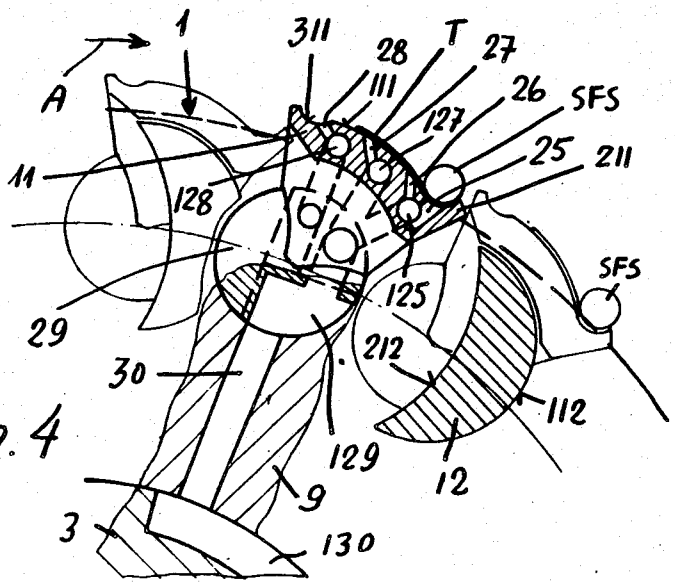
FIG. 4 is a cross-sectional view on a larger scale of some pairs of cooperating wrapping members.

During the rotation of the drum 1 in the direction of the arrow A, each movable wrapping member 11 moves cyclically to its wrapping initiation position, shown in the region B of FIG. 3. In this position and in this region B, the junction band T and the cigarettes-and-filter assembly SFS are laid onto the convex active surface 111 of the movable wrapping member 11 (now facing outwardly and entirely exposed), for example by means of a recessed feeding drum 34 rotating in the direction of the arrow A1 and carrying in each recess an assembly of two aligned cigarettes S with one interposed double filter F and with a glued junction band attached at one end thereof to said cigarettes-and-filter assembly SFS, as shown in the upper right-hand portion of FIG. 3. The assembly of two cigarettes S with the interposed double filter F, is accommodated within the arcuate merging surface between the shoulder 211 at the receiving end of the wrapping member 11 and the convex active surface 111 of said member, while the junction band T is stretched on the convex active surface 111 of said movable wrapping member. Upon reception of the cigarettes-and-filter assembly SFS into said arcuate merging surface between the shoulder 211 and the convex active surface 111 of the movable wrapping member 11, the junction band T, which initially was substantially tangent to cigarettes-and-filter assembly SFS or attached to said assembly on a very small arc, will be caused to adhere through a wide arc to the interposed double filter F and adjacent ends of the two cigarettes S, by virtue of the configuration of the shoulder 211 and merging surface thereof and by virtue of the suction exerted through the suction holes 25, 26. This considerable width of the arc through which the band T adheres to the cigarettes-and-filter assembly SFS just upon lying said assembly on each movable wrapping member 11, before beginning wrapping the band T, as a result of the rolling action, around the cigarettes-and-filter assembly SFS, constitutes one of the advantages of the device according to the invention.

While a cigarette-and-filter assembly SFS and a junction band T are being transferred from the feeding drum 34 to a movable wrapping member 11 on the drum 1, this wrapping member 11 keeps stationary with respect to the drum 1, in that the roller 22 of the respective toothed sector 20 moves along a portion of the cam groove 23 co-axially with the axis of rotation of said drum 1.

Thereafter, the cam groove 23 causes the movable wrapping member 11 to move from its wrapping initiation position to its wrapping termination position, that is in clockwise direction in FIG. 3 and with its receiving end (shoulder 211) directed fowardly. Thus, the cigarettes-and-filter assembly SFS engages the concave active surface 212 of the associated fixed wrapping member 12 and is rolled—as a result of the co-axial relative movement between the two opposite surfaces 111 and 212—over the convex active surface 111 of the respective movable wrapping member 11, and is thus wrapped in the junction band T. On completion of this wrapping operation resulting from the rolling action, that is when the movable wrapping member 11 reaches its wrapping termination position, that is completely retracted position within the respective arcuate radial channel between two fixed wrapping members 12, the assembly of two aligned cigarettes S and double interposed filter F with the wrapped junction band T is accommodated in the recess 311 at the delivery end of the active convex surface 111 of the movable wrapping member 11, as shown in the region C of the lower left-hand portion of FIG. 3.

The outline of the cam groove 23 is designed so that, during said angular movement of the movable wrapping member 11, the assembly of two aligned cigarettes S and one double interposed filter F engages the corner of the associated fixed wrapping member 12, that is the beginning of the concave active rolling surface 212 of said member 12, with the minimum possible speed, thereby minimizing the impact against the cigarettes-and-filter assembly SFS and eliminating the resulting drawbacks. The possibility to reduce at will the impact speed of the cigarettes-and-filter assembly SFS against the rolling surface 212 of the fixed wrapping member 12 and, therefore, to correspondingly minimize the impact force against the cigarettes-and-filter assembly SFS, is irrespective of the peripheral speed of the rotating drum 1 and constitutes a further advantage of the device according to the invention. Moreover, the provision of the shoulder 211 with an arcuate merging surface, in lieu of a recess, at the receiving end of the movable wrapping member 11, obviates the necessity to provide, on the concave active surface 212 of the fixed wrapping member 12, a stripping ridge to push the cigarettes-and-filter assembly SFS out of the recess accommodating the same and to start wrapping said assembly SFS in the junction band T. In the device according to the invention, the rolling movement of the cigarettes-and-filter assembly SFS is started much more smoothly, with no push or impact, thereby ensuring a great precision in wrapping the cigarettes-and-filter assembly SFS in the junction band T, and reducing considerably the risk of troubles.

After the cigarettes-and-filter assembly SFS, wrapped in a junction band T, has been accommodated in the recess 311 at the delivery end of the movable wrapping member 11 (region C in FIG. 3), said movable wrapping member 11 effects a return angular movement in the opposite direction, that is in clockwise direction in FIG. 3 and moves from the substantially radial position of wrapping completion, retracted in the arcuate channel between two fixed wrapping members 12, back to its position of wrapping initiation, substantially coaxial with the drum 1 and outside of the upstream fixed wrapping member 12 (with respect to the direction of rotation A of the drum 1). The movable wrapping member 11 reaches its position of wrapping initiation before passing again in front of the recesses feeding drum 34, wherefrom it will receive a new assembly of two aligned cigarettes S with double interposed filter F and attached junction band T, and the cycle described above will be repeated. During this return angular movement, at an intermediate position wherein the delivery end of the movable wrapping member 11 with the recess 311 and the cigarettes-and-filter assembly SFS wrapped in the band T is already protruding out sufficiently from the respective arcuate channel between two fixed wrapping members 12, said cigarettes-and-filter assembly SFS is picked up, for example, by a recessed drum 35, as shown in the left-hand portion of FIG. 3.

An important advantage of the device according to the invention is that any irregularity in the rolling movement for wrapping the cigarettes-and-filter assembly SFS in a junction band T on any one of the wrapping units provided peripherally of the drum 1 and each comprising a movable wrapping member 11 and an associated fixed wrapping member 12, will not be reflected to any upstream wrapping unit and will not affect the correct rolling movement on any other wrapping unit and will not cause any jamming or other obstruction, so that the device need not be stopped. The arcuate and substantially radial channels between the fixed wrapping members 12 are open at the end thereof corresponding to the front free end of the drum 1, whereby a visual check can be effected of the operations occurring within said channels, namely the rolling of the cigarettes-and-filter assemblies SFS and their wrapping in the junction bands T. In case of any trouble or irregularity in the rolling and wrapping operations, the cigarettes S, the double filter F and the junction band T may be ejected from the respective channel between two fixed wrapping members 12 through the open end thereof by means of a jet of air generated in the drum 1.

Another advantage of the device according to the invention resides in the relatively long period of time available for rolling the cigarettes-and-filter assembly SFS upon wrapping the same in the junction band T. Therefore, with a same speed of rotation of the drum 1, the cigarettes S will have a lower speed of rotation and, consequently, will be submitted to a lower stress.

Obviously, the invention is not limited to the embodiment here shown and described, but changes and modifications can be made thereto, especially in the construction thereof and within the technical equivalents, without departing from the basic principles set forth above and claimed hereinafter.

I claim is:

1. A wrapping device for wrapping a junction band around a cigarettes-and-filter assembly which includes a double filter interposed between the ends of two aligned cigarettes, the wrapping device receiving from an input device a cigarettes-and-filter assembly with a junction band attached thereto by an end margin thereof and delivering, to an output device spaced apart from the input device, the wrapped cigarettes-and-filter assembly, said wrapping device comprising:

a drum rotatably mounted adjacent said input and output devices;

a peripheral annular assembly of wrapping units angularly equi-spaced from each other around said drum, each wrapping unit including a first wrapping member fixedly mounted on said drum and having a first active surface with an arcuate curvature, and a second wrapping member movably mounted on said drum and having a second active surface with an arcuate curvature, one of said arcuate curvatures being concave and the other being convex, said arcuate curvatures being coaxially disposed and having different radii, said second wrapping member additionally having a delivery end portion and a receiving end portion between which the arcuate curvature of said second wrapping member is disposed; and means for moving the second wrapping member of a wrapping unit with respect to the first wrapping member thereof in a cycle between first and second predetermined positions as said drum rotates, said second active surface being directed away from said first active and exposed to said input device when said second wrapping member is in said first predetermined position, and said second active surface and delivery end portion being directed toward said first active surface when said second wrapping member is in said second predetermined position, wherein said cigarettes-and-filter assembly is deposited at said receiving end portion of said second wrapping member with said junction band stretched across said second active surface toward said delivery end portion when said second wrapping member is in said first predetermined position, wherein said cigarettes-and-filter assembly engages said first wrapping member and is rolled thereby over said second active surface to the delivery end portion to wrap said junction band as said second wrapping member moves to said second predetermined position, and wherein the wrapped cigarettes-and-filter assembly is moved from said delivery end portion to said output device as said second wrapping member returns to said first predetermined position.

2. A device according to claim 1, wherein said drum has an axis, wherein said first wrapping members comprise an annular assembly of elongated wings arranged substantially radially with respect to the axis the drum and extending longitudinally thereof and spaced from each other so as to form corresponding channels that are substantially radial, wherein said second wrapping members comprise an annular assembly of bent tiles, wherein each second wrapping member is movably mounted on said drum by mounting means for supporting the respective second wrapping member for angular movement about a respective axis which is parallel to the axis of the drum, wherein each second wrapping member is disposed radially outwards of a first wrapping member, with the second active surface thereof facing outwards, when the respective second wrapping member is in said first predetermined position, and wherein each second wrapping member is disposed in the substantially radial channel between two first wrapping members, with the second active surface thereof facing toward the first active surface of one of the first wrapping members, when the respective second wrapping member is in said second predetermined position.

3. A device according to claim 1, wherein said first active surfaces are concave and said second active surfaces are convex, wherein each first wrapping member is mounted for rotation about a respective pivot axis, and wherein the second active surface of the second wrapping member and the first active surface of the first wrapping member of each wrapping unit are configured as portions of cylinders that are co-axial with the pivot axis of the second wrapping member of the respective wrapping unit.

4. A device according to claim 1, wherein the receiving end portion of each second wrapping member comprises a shoulder merging with the second active surface of the respective wrapping member through a concave surface having a radius of curvature which is substantially the same as that of a cigarette.

5. A device according to claim 1, wherein each second wrapping member has a recess at the delivery end portion thereof.

6. A device according to claim 1, wherein the receiving end portion of each second wrapping member comprises a shoulder and means for providing a concave merging surface joining said shoulder to the second active surface of the respective second wrapping member, wherein each second wrapping member has a recess at the delivery end portion thereof, and wherein each second wrapping member has suction holes located partly in the concave merging surface and in the recess.

7. A device according to claim 6, wherein said drum has a drum axis, and further comprising a plurality of spindles having spindle axes, each spindle being rotatably mounted on said drum with the spindle axis thereof disposed parallel to the drum axis, each second wrapping member being connected to a respective spindle, and further comprising a rotary distributor provided at the spindle axis of each individual second wrapping member, each rotary distributor communicating with the suction holes of the respective second wrapping member, and means for connecting a vacuum source to each rotary distributor.

8. A device according to claim 7, wherein said means for connecting a vacuum source to each rotary distributor comprises a further rotary distributor disposed within said drum.

9. A device according to claim 1, wherein said means for moving comprises means for minimizing the relative velocity between the first and second wrapping members of a wrapping unit as the cigarettes-and-filter assembly engages the first wrapping member of the wrapping unit.

10. A device according to claim 1, wherein said first wrapping members have crescent-shaped cross-sections.

11. A device according to claim 1, wherein the receiving end portions of each second wrapping member comprises a shoulder and means for providing a concave merging surface joining said shoulder and the second active surface of the respective second wrapping member, and wherein the cigarettes-and-filter assembly is deposited onto the concave merging surface with the junction band attached thereto extending under the cigarettes-and-filter assembly and conforming to the curvature of the concave merging surface.

12. A device according to claim 13, wherein said drum has an axis, wherein said first wrapping members comprise an annular assembly of elongated wings arranged substantially radially with respect to the axis of said drum and extending longitudinally thereof and spaced from each other so as to form corresponding channels that are substantially radial, said channels being open at least at one end thereof, and further comprising means for blowing jets of air through said channels from the interior toward the open ends thereof, to eject the cigarettes-and-filter assemblies and junction bands in case of any irregularity in the wrapping.

13. A device according to claim 1, wherein the receiving end portion of each second wrapping member comprises a shoulder merging with a shallow depression in the second active surface of the respective second wrapping member to provide a concave surface having a radius of curvature which is substantially the same as that of a cigarette.

14. A device according to claim 1, wherein said drum has a drum axis, and further comprising a plurality of spindles having spindle axes, each spindle being rotatably mounted on said drum with the spindle axis thereof disposed parallel to the drum axis, each second wrapping member being connected to a respective spindle, and wherein said means for moving comprises pinions mounted on the spindles, pivotably mounted toothed sectors meshing with the pinions, a stationary portion having a cam groove, and movably mounted lever arms operatively connecting the cam groove to the toothed sectors.

* * * * *